US011814277B2

(12) United States Patent
Becher

(10) Patent No.: US 11,814,277 B2
(45) Date of Patent: Nov. 14, 2023

(54) APPARATUS AND METHOD FOR FILLING A CONTAINER WITH A FILLING PRODUCT

(71) Applicant: KRONES AG, Neutraubling (DE)

(72) Inventor: Valentin Becher, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 17/537,878

(22) Filed: Nov. 30, 2021

(65) Prior Publication Data

US 2022/0169488 A1 Jun. 2, 2022

(30) Foreign Application Priority Data

Dec. 1, 2020 (DE) ..... 10 2020 131 817.0

(51) Int. Cl.

| | |
|---|---|
| ***B67C 3/02*** | (2006.01) |
| ***B67C 3/22*** | (2006.01) |
| ***B67C 3/28*** | (2006.01) |
| ***B67C 3/06*** | (2006.01) |

(52) U.S. Cl.

CPC ..... *B67C 3/026* (2013.01); *B67C 3/06* (2013.01); *B67C 3/225* (2013.01); *B67C 3/28* (2013.01)

(58) Field of Classification Search

CPC ..... B67C 3/284; B67C 3/28; B67C 3/225; B67C 3/06; B67C 3/026; B67C 2003/268

See application file for complete search history.

(56) References Cited

U.S. PATENT DOCUMENTS

| | | | | |
|---|---|---|---|---|
| 4,156,444 | A | 5/1979 | Mette | |
| 5,125,441 | A * | 6/1992 | Mette | B67C 3/26 141/59 |
| 2003/0150517 | A1 | 8/2003 | Decarne | |
| 2021/0354969 | A1 * | 11/2021 | Clüsserath | B67C 3/284 |

FOREIGN PATENT DOCUMENTS

| | | | |
|---|---|---|---|
| DE | 72 38 305 | U | 1/1973 |
| DE | 102019118937 | A1 | 1/2021 |
| EP | 0237823 | A1 | 9/1987 |
| EP | 2272790 | A1 | 3/2013 |
| WO | WO 2020/083654 | A1 | 4/2020 |

OTHER PUBLICATIONS

Extended European Search Report for EP application No. 21211660.2 dated Apr. 29, 2022, 8 pages.

Search Report for DE application No. 10 2020 131 817.0 dated Mar. 31, 2023, 7 pages.

* cited by examiner

*Primary Examiner* — Jason K Niesz

(74) *Attorney, Agent, or Firm* — Haynes and Boone, LLP

(57) ABSTRACT

An apparatus and method for handling a container, comprising filling the container with a filling product, for example with a beverage in a beverage bottling plant, wherein the apparatus has: a valve main body with an outlet for introducing the filling product into the container and with a swirl chamber which is fluidically connected to the outlet and is configured to induce a swirling motion in the filling product as the latter is being introduced into the container; a valve cone which is at least partially arranged in the valve body, defines an axial direction and through which a gas duct penetrates in the axial direction; and a sensor device with a sensor head which is configured to detect at least one signal and is arranged in the gas duct.

19 Claims, 3 Drawing Sheets

APPARATUS AND METHOD FOR FILLING A CONTAINER WITH A FILLING PRODUCT

CROSS-REFERENCE TO RELATED APPLICATIONS

This application claims priority from German Patent Application No. DE 10 2020 131 817.0, filed on Dec. 1, 2020 in the German Patent and Trademark Office, the disclosure of which is incorporated herein by reference in its entirety.

BACKGROUND

Technical Field

The present invention relates to an apparatus and a method for handling a container, comprising filling the container with a filling product, for example with a beverage in a beverage bottling plant.

Related Art

Filling members of a variety of types are known for bottling fluids in the food sector. A differentiation is made here between the base product types of non-carbonated (still) and carbonated (CSD) liquids. In the case of non-carbonated products, such as, for example, when bottling still water, juice, etc., the liquid is conventionally filled into the container in a free jet. In contrast thereto, when bottling carbonated products, for example beer, sparkling water, soft drinks, etc., the liquid is conventionally conducted into the container along the inner wall thereof in order to reduce degassing and frothing.

The flow of the filling product through the filling member and thus the introduction into a container is normally controlled by means of a filling valve which comprises a valve cone which is seated in a valve receptacle of complementary shape with respect to the valve cone. The filling operation is thus started by the valve cone being lifted out of the valve receptacle, and the filling operation is ended again by the valve cone being subsequently lowered onto the valve receptacle.

During the bottling in particular of carbonated products, the container which is to be filled can be sealed off from the filling member. In order to further reduce degassing and frothing, the container can be placed under a positive pressure within the scope of what is referred to as the counterpressure method so that the $CO_2$ is retained in the liquid phase. For this purpose, the container is pressed gas-tightly onto the filling member and pressurised with a pressurising gas, for example $CO_2$, prior to the start of the filling. The bottling begins after the pressurisation. Instead of a valve cone, as in the case of free-jet bottling, a swirl body takes over the function of opening/closing the valve and furthermore induces a rotational movement in the flowing liquid. If the swirl body is raised, the product flows via a fluidically optimised contour for the wall bottling through the annular gap into the pressed-on container. The liquid is driven outwards by the centrifugal forces of the rotation and then flows along the inner wall of the container, for which reason this type of bottling is also referred to as "wall bottling". At the same time, the gas in the container can escape via a bore in the swirl body and in a valve rod attached thereto. At the end of the filling, the annular gap is closed by the swirl body being pressed against the outlet contour. The container is subsequently relieved of load to ambient pressure and separated from the filling member.

The filling operation can accordingly have a series of steps, comprising pressing the container pressure-tightly against the filling member, exchanging gas in particular in the case of oxygen-sensitive filling products, increasing the pressure or reducing the pressure in the container, introducing the filling product and relieving the container of load.

The filling members are conventionally provided with sensors in order to monitor one or more steps of the filling operation. The metering of the filling product into the container can thus be monitored, for example, by means of a flow meter in the product feed or an electric rod probe entering the container mouth. In contrast to free-jet bottling, the container weight cannot be measured during the wall bottling, since the container is pressed onto the filling member. It is furthermore known to integrate a pressure sensor into the gas path of the filling member in order thereby to monitor the intended positive pressure or negative pressure in the container. For the information as to whether a container is correctly present below the filling member, use is conventionally made of ultrasonic barrier sensors which, for cost reasons, are not installed on the rotating carousel, but rather in a stationary manner at the inlet and optionally at some additional locations.

The sensors described above monitor the filling of the container either indirectly, for example via the flow of the filling product into the container, or directly by a probe entering therein. In both cases, however, a defective filling operation can be identified only to a limited extent since only the step of introducing the filling product into the container is monitored. However, the formation of froth, in particular in the case of carbonated beverages, cannot be monitored, or only monitored insufficiently, in the steps of introducing the filling product into the container and relaxing the container. An additional pressure sensor in the filling member may be used to monitor the steps of exchanging gas in the container, increasing the pressure or evacuating same and relieving load; however, the pressure sensor is normally an additional sensor installed in each filling member. The metering of the filling product into the container cannot be satisfactorily monitored by a pressure sensor, and therefore, furthermore and in addition, a flow meter and/or a filling height probe are/is required. The steps of inserting and removing the container are either not monitored or are monitored by further sensors.

In summary, the filling operation is currently monitored either by use of a multiplicity of sensors, which leads to high costs, a high maintenance effort, etc., or a compromise is sought, in which only the most required steps are monitored, and this in turn is at the expense of reliability and quality.

SUMMARY

An improved apparatus and an improved method for handling a container, comprising filling the container with a filling product, in particular to improve the reliability of the bottling member while simultaneously simplifying the mechanical engineering are described herein according to various embodiments.

The apparatus and the method according to certain embodiments serve for handling a container, for example in a beverage bottling plant. This includes at least filling the container with a filling product.

Products to be bottled are in particular beverages, for example water, soft drinks, beer, mixed beverages and the like. Carbonated beverages are, in some embodiments, bottled.

In addition to the actual introduction of the filling product into the container, further steps may be expedient or required depending on the filling product and/or process. It is thus required, within the scope of a counterpressure method or negative pressure method, to press the container against a mouth of the filling member and to subject the container to a corresponding negative pressure or positive pressure. Furthermore, steps of flushing, cleaning, pressurising, evacuating, relieving load, etc. can be part of the filling operation and are referred to herein jointly as "handling" of the container.

The apparatus according to several embodiments, which is also referred to herein as "filling member", comprises a valve main body with an outlet for introducing the filling product into the container and with a swirl chamber which is fluidically connected to the outlet and is configured to induce a swirling motion in the filling product as the latter is being introduced into the container. Furthermore, the apparatus has a valve cone which is at least partially arranged in the valve body, defines an axial direction and, in one embodiment, forms at least part of the wall of the swirl chamber. A gas duct penetrates the valve cone in the axial direction.

The valve cone extends, in certain embodiments, in the axial direction through the valve main body, wherein the wording "extends . . . through" should not be understood as meaning that the valve cone protrudes beyond the valve main body on both sides in the axial direction. In other words, the size of the valve cone in the axial direction may be smaller than that of the valve main body.

The valve cone is configured so as to be displaceable, for example, in the axial direction for controlling the flow of the filling product through the outlet. For this purpose, the valve cone interacts, for example, with a valve seat which can be part of the valve main body.

The term "controlling the flow" herein means a change in the flow by adjusting the valve cone, with complete suppression of the flow, i.e. a flow of zero, being included. A binary switching on and off of the flow is therefore also included under controlling the flow, as is a gradual change in the volumetric flow. The valve cone is, in some embodiments, adjustable in a translational manner along the axial direction determined by the valve cone and outlet. The valve cone can be adjustable gradually within a working path.

During the filling, the container mouth is normally located directly below the outlet. For this purpose, the container mouth can lie against a mouth section of the valve main body. Alternatively, the filling member can also be used as a free-jet valve.

According to certain embodiments, the apparatus comprises a sensor device with a sensor head which is configured to detect at least one signal and is arranged in the gas duct.

The sensor device is, in various embodiments, the sole sensor of the filling member, i.e. the present disclosure makes it possible for the filling member not to have any further sensors, for example a flow meter or a filling level probe, since the sensor device described herein is arranged and configured in such a manner that not only one, but in some embodiments a plurality of measured variables can be monitored during the handling of the container.

The use of such a sensor device placed in the gas duct of the filling member with a swirl chamber permits a simplification in terms of mechanical engineering since sensors used hitherto, for example for flow, filling level, container detection (Flada) and pressure, can be replaced and at the same time a plurality of, or even all of the, steps in the filling operation can be monitored continuously with one sensor. This leads to a lower maintenance effort, improved reliability and a saving on costs because there are fewer sensors and fewer variants.

Furthermore, steps or sequences during the filling operation that could only be monitored insufficiently, if at all, hitherto, for example relating to the operation of positioning and/or pressing the container against the mouth section of the filling member, can be monitored by the sensor device.

By means of a compact construction of the filling member, the sensor head can be positioned at a very short distance from the container mouth, as a result of which a large field of view of the sensor can be obtained. This is further assisted by the swirling of the filling product, as a result of which a stable "eye" is formed during the bottling, through which eye the sensor head can "look close" without interference.

Since the filling member with the valve main body can be used both for wall bottling and for free jet filling or for products to be bottled atmospherically, the multiplicity of filling member variants for different applications is reduced. The care and maintenance effort and the number of machine variants are therefore reduced. Bottling plants which are equipped with filling members of the type described herein are universally useable. They can be used to bottle a great diversity of different beverages, container formats and materials (PET, glass, can, still, carbonated, etc.).

The sensor head in some embodiments has a transmit/receive surface which is configured to emit a transmit signal in the direction of the container and to receive a receive signal initiated by the transmit signal. The receive signal initiated by the transmit signal can be, for example, a reflection of the transmit signal or a signal induced by the transmit signal. In other words, according to this embodiment, the sensor head emits a transmit signal into the container positioned on or below the outlet. The container, or a gas or fluid located therein initiates or influences, for example, a reflection of the signal which in turn is detected by the sensor head. From the attenuation, propagation delay, interference, etc., measured variables can now be inferred, for example the distance from the container base, the filling height in the container, the froth content, the froth height, gas composition, gas pressure, structural composition of the container and the like.

The transmit signal is in various embodiments an ultrasonic signal. In other words, the sensor device is in certain embodiments configured as an ultrasonic reflex scanner or ultrasonic sensor. In this case, the gas duct and the container wall form a resonance space for the ultrasonic signal. The container bottom or the liquid surface act as reflection surfaces. However, the sensor device can also use a different measuring principle or measuring method, for example an optical measurement or a measuring method based on radar waves or microwaves.

The apparatus in one or more embodiments has an evaluation device which communicates with the sensor device and is configured to infer one or more measured variables from the signals detected by the sensor device. The desired measured variable can be calculated, for example, from the detected signals, can be taken from a functional relationship or a database or determined in some other way. Suitable measured variables include in particular: filling height of the filling product in the container; gas pressure, gas composition or gas concentration in the gas duct and container; froth quantity/height and/or froth composition in the container; container position; structural state of the container, i.e., for example, whether the container is defective. The communication between the sensor device and the evaluation device can take place in analogue or digital form, and in wireless or wired form. Furthermore, the sensor device and the evaluation device can be realised integrally or by separate electronic components. The evaluation device can thus be installed, for example, together with the sensor head, in a single sensor housing.

The apparatus in several embodiments furthermore has a filling member controller which communicates with the evaluation device and is configured to control and/or to regulate the handling of the container. The measured variables determined by sensor device and evaluation device can therefore be used for controlling or regulating the filling operation. The handling here in some embodiments comprises one or more of the following steps: positioning the container relative to the filling member; pressing the container pressure-tightly against a mouth section of the valve main body; introducing a gas (for example $CO_2$, pure air, nitrogen, etc.) through the gas duct into the container, for example in order to flush, to clean and/or to pressurise the container; drawing off a gas out of the container through the gas duct; generating a positive pressure in the container; generating a negative pressure in the container; introducing the filling product into the container; relieving the container of load; removing the container from the mouth section of the valve main body.

The wordings "positioning the container relative to the filling member" and "pressing the container pressure-tightly against a mouth section of the valve main body" not only comprise a movement of the container relative to the filling member, but, alternatively or additionally, the filling member itself can also be moved in order to obtain the desired relative position between filling member and container.

The terms "positive pressure" and "negative pressure" should be understood primarily as meaning relative to each other, but they can also refer to normal pressure.

The evaluation device can be part of the filling member controller or can communicate with such in order to control and/or to regulate the bottling operation. The communication can take place in analogue or digital form and in wired or wireless form. The evaluation device and filling member controller can be implemented centrally or decentrally as a component of Internet-based and/or cloud-based applications or in some other way, and can optionally make recourse to databases. The evaluation device and filling member controller can be implemented by a computer unit, for example with software support.

The swirl chamber in certain embodiments has an annular shape or, more specifically, the shape of a torus, the cross-sectional contour of which has a round shape in the direction of extent and perpendicularly to the direction of extent. The swirl chamber in various embodiments extends substantially axially symmetrically about the valve cone.

In other words, the swirl chamber wall is substantially continuous and differentiable geometrically, for example both along the annular axis thereof and perpendicular thereto. The term "substantially" firstly refers to the fact that corners are not always avoidable, for example in the mouth regions of a main inlet and in any secondary inlets described further below, and secondly that geometric terms such as "continuous", "differentiable", "corner points", etc., are not to be interpreted as ideal mathematical terms. It is important in this regard that the mentioned cross-sectional contours of the swirl chamber do not have a polygonal, for example rectangular, shape.

It should be pointed out that spatial terms, such as, for example, "under", "below", "over", "above", etc., refer to the installed position of the filling member, which position is clearly determined by the direction of gravity. In the installed state, the axial direction thereof coincides at least substantially with the direction of gravity.

According to this embodiment variant, the valve main body requires neither swirl bodies, such as, for example, guide vanes or swirl ducts, nor additional flow guides, and is therefore very compact, hygienic and tolerant to disperse solid/liquid mixtures which, for example, contain pieces of fruit, slurry, fruit fibres or the like. Furthermore, the size of pieces in the flow is scarcely restricted because of omitting swirl bodies. The valve main body permits complete flushing out of the valve interior with a minimum flushing quantity, owing to high turbulence achievable in the swirl chamber, and a comparatively small surface area. In addition, the swirl chamber has substantially no corners in which flavourings, pieces of fruit and the like could collect. The capacity for flushing is thereby also optimised. For these reasons, the valve main body is particularly suitable for flexible changing of the filling product, including the container, in particular by components which can be metered in.

The swirl chamber, as mentioned above, for example has the shape of a torus. The term "torus" here not only denotes a rotational body constructed from a circular contour, although this may be the case in one or more embodiments, but the rotational contour or rotational surface may also be elliptical, oval or rounded in some other way, as long as polygonal corners and edges are omitted. Such a rotationally symmetrical construction further assists the formation of a uniform swirling motion and the capacity for flushing out.

The swirl chamber in various embodiments extends substantially axially symmetrically about the valve cone. In this case, the valve cone penetrates the swirl chamber centrally, as a result of which the valve cone synergetically forms part of the wall forming the swirl chamber. In this way, the valve main body can be configured even more compactly, with the functionalities of the valve cone and the swirl chamber being structurally integrated.

The valve main body in one or more embodiments has a main inlet which opens tangentially into the swirl chamber and is configured to introduce the filling product or a main component of the filling product into the swirl chamber in such a manner that a swirling motion is induced in the filling product in the swirl chamber.

The term "tangentially" herein does not require a geometrically perfect tangential connection of the main inlet. Instead, it may be structurally expedient to permit the main inlet to open at a specific angle into the swirl chamber. It is important that the inflow direction in this case takes place substantially laterally and on the wall side, i.e. not from above or laterally centrally, and thus directly leads to a swirling motion, i.e. annular flow, in the swirl chamber.

The tangential inflow of the filling product from the main inlet into the swirl chamber induces an optimum swirling motion in the filling product, as a result of which the filling product is driven outwards by centrifugal force and, after exiting from the outlet, flows downwards in a spiral movement on the container wall. The tapering or constriction of the swirl chamber towards the outlet results in a drop in pressure, and therefore in stabilisation, of the swirling motion. This, firstly, results in a uniform, well-defined swirling motion across the periphery and, secondly, is a significant determining factor for the flow rate. The lateral main inlet, i.e. opening tangentially into the swirl chamber, also provides space above the swirl chamber. The space is unobstructed and can be used to widen the valve main body modularly, for example with the sensor device described above, and therefore the formation of variants or differentiation of the filling member for specific applications can be carried out later, thus saving on costs and resources.

In some embodiments, at least the axial outer wall of the swirl chamber merges continuously and differentiably into the main inlet in order to optimise the formation of the swirling motion and the capacity for flushing out. For the same reasons, the main inlet in the region of the mouth leading into the swirl chamber in one embodiment has substantially the same cross-sectional contour perpendicularly to the direction of extent as the swirl chamber. Both contours are in certain embodiments circular with a substantially identical diameter. In this way, the tangential supply of the filling product merges optimally into the annular flow within the swirl chamber.

The outlet is in some embodiments annular, with the swirl chamber which is likewise annular tapering gradually towards the outlet, as a result of which the filling product after exiting from the outlet flows downwards in a spiral movement in the container. Rapid and controlled bottling can be implemented by means of a targeted acceleration of the filling product in the annular duct between swirl chamber and outlet. The swirl chamber in certain embodiments has a shape which is axially symmetrical with respect to the axis of the annular outlet.

The valve main body in various embodiments has a valve seat, wherein the valve cone and the valve seat are configured in such a manner that, in a shut-off position, the valve cone is sealingly in contact with the valve seat for completely sealing the outlet. The integration of flow control function and shut-off function in the valve main body permits a reduction in the number of components and a simplification of the product path. This leads to lower pressure losses and contributes to a more careful handling of the product and to reduced froth formation during the filling operation.

The valve cone in several embodiments has a conical outlet contour which tapers towards the outlet and extends at least partially into the swirl chamber. In this way, the design of the valve main body is particularly compact.

The valve main body in some embodiments has one or more secondary inlets which open into the swirl chamber and are configured to correspondingly introduce one or more additional components of the filling product into the swirl chamber in such a manner that said additional components are mixed therein with the main component. By means of the secondary inlets, any additional components are mixed in directly in the swirl chamber, as a result of which good capacity for flushing out the valve main body is ensured and a possible migration of flavourings is minimised. In addition, the filling member is therefore particularly suitable for applications in bottling plants which are provided for flexible metering and immediate changing of the product.

In this case, the filling product is mixed together from a plurality of components, a main component, such as, for example, water or juice, and at least one additional component, such as, for example, syrup, directly in the swirl chamber of the filling member. In this case, during the bottling operation, the additional components of the filling product are introduced into the swirl chamber and passed together with a swirling motion into the container to be filled.

The additional component(s) can be introduced into the swirl chamber in such a manner that the main component, which was previously supplied through the main inlet, is displaced to the rear. The displaced volume of the main component is determined, for example, by means of a flow meter, and thus the volume of the metered-in component(s) is also known and controllable. During the subsequent decanting of the filling product into the container, the main component together with the metered-in components is completely flushed out of the filling member into the container, with it being possible at the same time to determine the total filling quantity using the same flow meter or the sensor device. During the next decanting cycle, the filling quantities and also the metered-in component quantities can be determined again. A highly flexible and hygienic bottling of customised beverages is thus possible substantially without changeover times.

The valve main body in one embodiment comprises a valve housing which forms at least part of the wall bounding the swirl chamber and the outlet, as a result of which the valve main body is structurally simplified and is particularly reliable. The valve housing can be produced integrally. The valve housing is in certain embodiments a cast body.

At least one of the secondary inlets is in some embodiments formed by openings in the valve housing. By integrating the supply of metered components into the valve housing, no hoses or additional lines are required. In this manner, in a structurally simple and reliable manner, the capacity for flushing out the valve main body is optimised and a possible migration of flavourings is minimised.

The valve main body in several embodiments has a membrane made of a deformable material, which forms a part of the wall bounding the swirl chamber, for example in the upper region. The membrane is attached at an outer contour, which is in certain embodiments circular, to the valve housing, and, at an inner contour, which is in one or more embodiments circular, to the valve cone. The lateral main inlet, i.e. opening tangentially into the swirl chamber, in addition to the aforementioned technical effects, provides space above the swirl chamber which can be used for mounting the membrane which seals the swirl chamber in the upper region.

The membrane is produced from a deformable or flexible material, as a result of which it can follow the axial movement of the valve cone and at the same time ensures a hygienic seal. The working region of the valve cone at the same time determines the degree of deformability which the material of the membrane has to perform. By means of this functionality, the terms "flexible", "deformable", etc. are determined with respect to the membrane. The flexibility of the membrane and the material composition, in particular in the case of Teflon, additionally assist a decanting of the filling product with a swirling motion, even if the filling streams are very small. A possible unintended local maximum flow at the beginning of the bottling operation, before a uniform flow is set with the swirling motion, can be counteracted by adjusting the valve cone or by a control valve located upstream.

The symmetry of the membrane additionally permits a design with a high load cycle, as is generally required for filling members. The membrane in one embodiment has an annular clamping section which is configured for fastening to the valve housing.

The apparatus in various embodiments has at least one gas path which opens laterally into the gas duct. It is thus possible, for example, to provide a gas feed line, in order to supply pressurising gas, flushing gas and/or the like to the gas duct, and a gas discharge line, in order to discharge gas from the container, as gas paths. The one or more gas paths are in several embodiments correspondingly designed as a flexible hose, as a result of which they can compensate for the axial movement of the valve cone.

One or more of the gas paths in some embodiments open substantially directly below the sensor head into the gas duct. In this manner, soiling of the sensor head can be suppressed or at least reduced by a synergetic action of the gas flows in the gas duct.

One or more of the gas paths can be guided tangentially into the central gas duct. Such a tangential arrangement of the gas paths results in effective cleaning of the sensor head in a cleaning mode, for example with water.

A method for handling a container, comprising filling the container with a filling product, for example with a beverage in a beverage bottling plant according to various embodiments is also described herein, wherein the method comprises: providing an apparatus according to one of the embodiment variants described above; introducing the filling product into the swirl chamber of the valve main body and inducing a swirling motion in the filling product in the swirl chamber; discharging the swirling filling product from the swirl chamber via the outlet of the valve main body into the container, as a result of which the filling product flows along the container inner wall into the container; and detecting at least one signal which propagates from the container through the gas duct by the sensor head of the sensor device.

The features, technical effects, advantages and exemplary embodiments which have been described with regard to the apparatus apply analogously to the method.

For the abovementioned reasons, one or more measured variables are thus in some embodiments inferred from the signals detected by the sensor device, in particular a filling height of the filling product in the container and/or a gas pressure, gas composition or gas concentration in the gas duct and container and/or a froth quantity/height or froth composition in the container and/or a container position and/or a structural state of the container.

For the abovementioned reasons, the handling of the container in one or more embodiments comprises one or more of the following steps: positioning the container relative to the filling member; pressing the container pressure-tightly against a mouth section of the valve main body; introducing a gas through the gas duct into the container; drawing off a gas out of the container through the gas duct; generating a positive pressure in the container; generating a negative pressure in the container; introducing the filling product into the container; relieving the container of load; removing the container from the mouth section of the valve main body.

Further advantages and features of the present invention according to various embodiments are apparent from the following description of exemplary embodiments. The features described therein can be implemented individually or in combination with one or more of the features set forth above, insofar as the features do not contradict one another. The following description of exemplary embodiments is made with reference to the accompanying figures.

BRIEF DESCRIPTION OF THE FIGURES

Further embodiments of the invention will be described in more detail by the following description of the figures.

DETAILED DESCRIPTION

Exemplary embodiments will be described below with reference to the figures. Elements which are identical, similar or act in an identical manner are provided with identical reference signs in the figures, and a repeated description of these elements is dispensed with in some cases in order to avoid redundancies.

Figure 1:
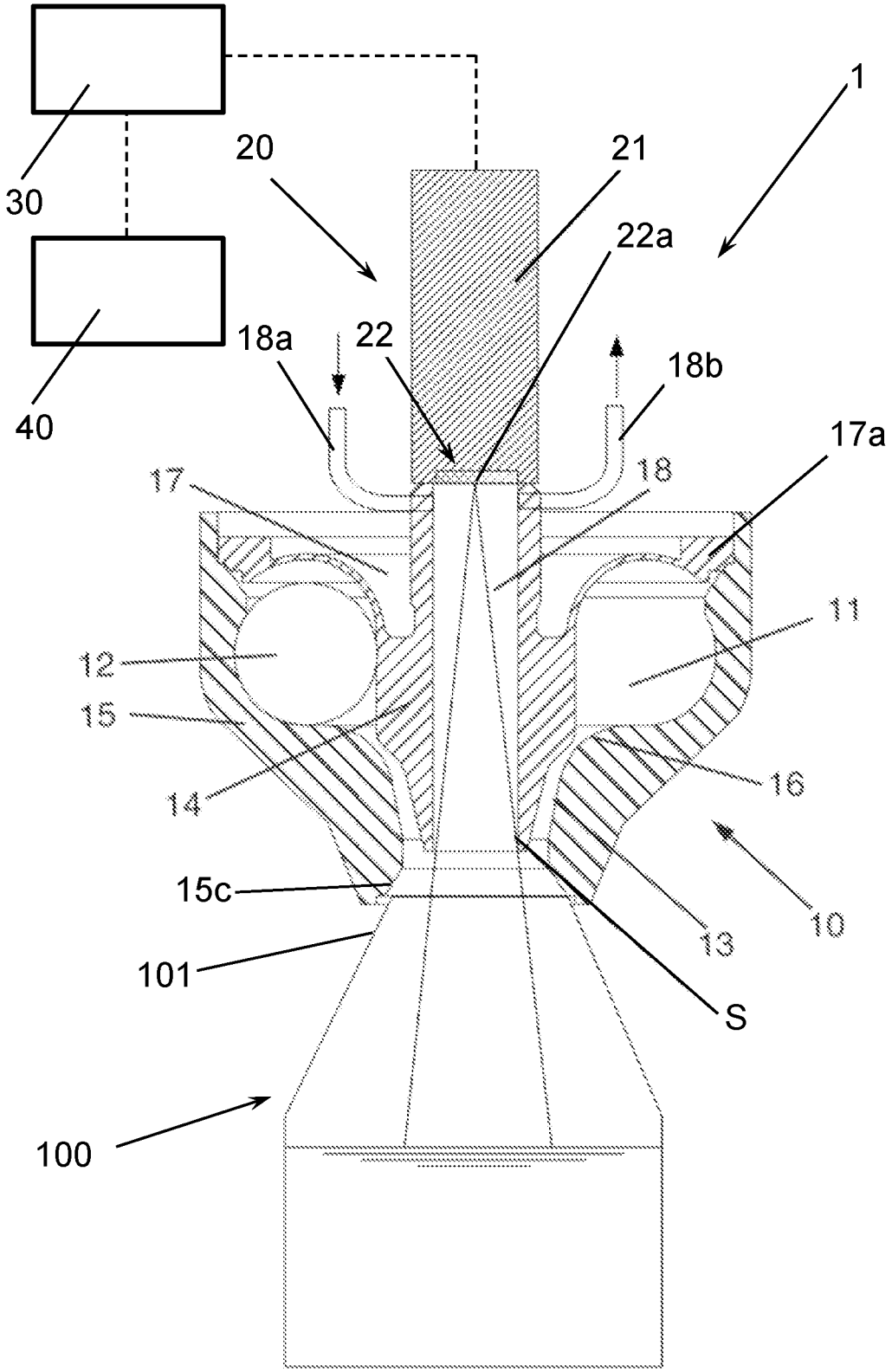
FIG. 1 shows a schematic cross section of a filling member with a sensor device, an evaluation device and a filling member controller.

FIG. 1 is a schematic cross-sectional view of an apparatus 1 for filling a container 100 with a filling product. The apparatus 1 is also referred to herein as "filling member" or comprises such a filling member. Products to be bottled include in particular beverages, for example water, soft drinks, beer, mixed drinks and the like. In some embodiments, carbonated beverages are bottled by the filling member 1.

Figure 2:
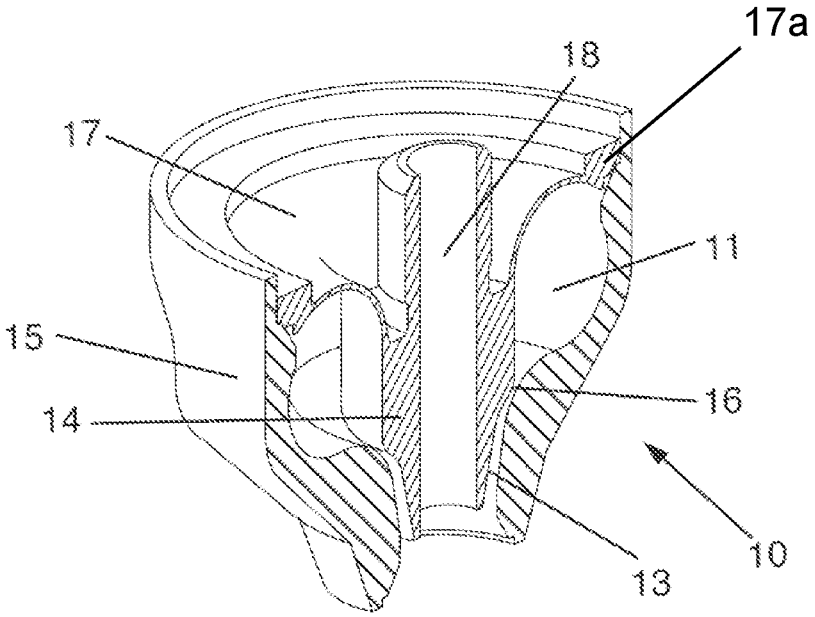
FIG. 2 shows a perspective sectional view of a valve main body of the filling member with swirl chamber, valve cone and membrane.
Figure 3:
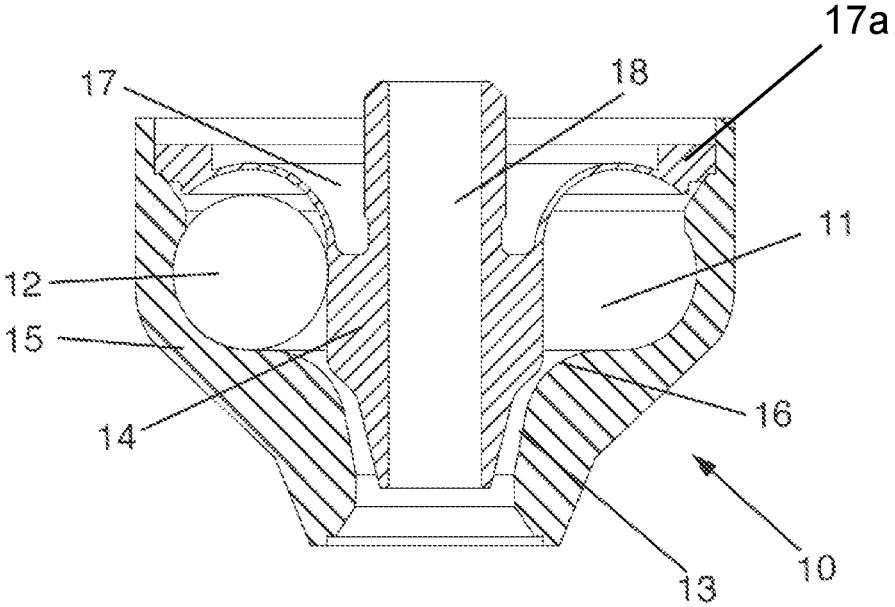
FIG. 3 shows a cross-sectional view of the valve main body from FIG. 2.

The filling member 1 comprises a valve main body 10. FIG. 2 is a perspective view of the valve main body 10. FIG. 3 shows the valve main body 10 in a cross-sectional view.

The valve main body 10 has a swirl chamber 11 designed as an annular duct or torus. The valve main body 10 furthermore has a main inlet 12 which is not visible in the perspective view in FIGS. 1, 2 and 3 and opens tangentially or substantially tangentially into the swirl chamber 11. The main inlet 12 is shown in the exemplary embodiment of FIGS. 4 and 5.

In the lower region of the valve main body 10, the swirl chamber 11 tapers towards an annular outlet 13, from which the filling product exits during the bottling operation and runs into a container 100 placed below the valve main body 10.

It should be mentioned that spatial terms, such as "under", "below", "over", "above", etc., refer to the installed position of the filling member 1, which is clearly determined by the direction of gravity. Furthermore, the annular outlet 13 means that the filling member 1 or the valve main body 10 thereof has a clearly defined axial direction which, in the installed state, coincides at least substantially with the direction of gravity.

The tangential supplying of the filling product from the main inlet 12 into the swirl chamber 11 induces a swirling motion in said filling product, as a result of which the filling product is driven outwards due to centrifugal force and, after exiting the valve main body 10, passes further outwards and flows downwards on the container wall. The tapering or constriction of the swirl chamber 11 towards the outlet 13 firstly leads to a uniform, well-defined swirling motion across the periphery and, secondly, is a significant determining factor for the flow rate. If the degree of tapering, in particular the size of the annular gap at the outlet 13, is adjustable, an integrated flow control can therefore be realised, optionally including the shutting-off thereof.

The aforementioned flow control can be implemented as follows: according to the exemplary embodiment of FIGS. 1, 2 and 3, the valve main body 10 for this purpose has a valve cone 14 which has a cylindrical shape tapering towards the outlet 13. The annular gap adjoining the swirl chamber 11 is at least partially formed on the inside by the outer peripheral surface of the valve cone 14. On the outside, the annular gap is defined and/or formed by a valve housing 15. According to the present exemplary embodiment, the valve cone 14 is configured to be displaceable in the axial direction, i.e. upwards and downwards. The annular gap can thereby be enlarged and reduced at the outlet 13. The height adjustment of the valve cone 14 is undertaken, for example steplessly, within a working region, i.e. between a fully open position and a closed position or a position of minimum flow. If, by the internal shape of the valve housing 15, a valve seat 16 is formed which is in sealing contact with the valve cone 14 in a closed position of the filling member 1, the outlet 13 can be completely closed, as a result of which a shutting-off function is realised.

The lateral main inlet 12, i.e. opening tangentially into the swirl chamber 11, also provides space above the swirl chamber 11, in addition to the aforementioned technical effects. The space is unobstructed and can be used for mounting a membrane 17, which seals the swirl chamber 11 in the upper region.

The membrane 17 has a circular outer contour which is attached directly or indirectly via a fastening means to the valve housing 15. The membrane 17 is fastened radially on the inside to the valve cone 14. The membrane 17 is produced from a flexible material, for example Teflon, as a result of which it can follow the axial movement of the valve cone 14 and at the same time ensures hygienic sealing of the swirl chamber 11. The symmetry of the membrane 17 also permits an embodiment with a high load cycle, as is generally required for filling members 1.

The valve main body 10 furthermore has a gas duct 18 which centrally penetrates the valve cone 14 in the axial direction. The gas duct 18 serves for introducing a gas, such as, for example, flushing gas, pressurising gas and the like, and acts at the same time as a return gas duct in order to divert any gas which has to be removed during gas exchange and/or is displaced out of the container 100 during the filling operation. However, the gas duct 18 can also be realised as a multi-duct construction, for example a pipe-in-pipe construction, for example in order to provide separate supply and exhaust gas paths.

Opening laterally into the gas duct are one or more gas paths 18*a*, 18*b*, for example a gas feed line 18*a*, in order to supply the gas—pressurising gas, flushing gas, etc.—to the gas duct 18, and a gas-diverting line 18*b* in order to divert gas out of the container 100. The gas paths 18*a*, 18*b* are in some embodiments each designed as a flexible hose, as a result of which they can compensate for the axial movement of the valve cone 14.

The valve cone 14 ends essentially directly below a throttle point, i.e. the narrowest point of the annular gap forming the outlet 13, as a result of which a defined change from a single-phase separated flow to a wall film flow is realised in the container 100. Thus, a well-defined uniform separation edge of the liquid is formed, specifically at the point with the greatest flow rate. The valve seat 16, i.e. the shut-off point, is in several embodiments located in the immediate vicinity of the separation edge, as a result of which the surfaces which could lead to dripping are minimised.

The valve cone 14 is in one or more embodiments produced from Teflon, as a result of which the outflow behaviour is improved owing to the low surface energy. If, in addition, the valve housing 15 is produced from stainless steel, a full seal can also be ensured by such a material pairing, even in the event of high pressure differences.

Apart from the valve cone 14, the valve main body 10 does not require swirl bodies, for example guide vanes or swirl ducts, or additional flow guides, and is therefore highly hygienic and tolerant to disperse solid/liquid mixtures which contain, for example, pieces of fruit, slurry, fruit fibres or the like. Furthermore, the size of the pieces in the flow is scarcely restricted because of the lack of swirl bodies. In order to bottle large pieces, for example having volumes of 5×5×5 mm or more, the valve cone travel during the filling operation can be flexibly increased.

The valve main body 10 is particularly suitable for the aforementioned wall bottling, in which the filling product runs downwards spirally on the inner wall of the container. However, a filling member 1 provided with the valve main body 10 can also be used as a free-jet valve. In this case, the valve main body 10 can be used as a hygienic control valve, by the latter being installed in a corresponding filling product line with an adjoining steadying section and optionally a gas barrier at the outlet. If required, the swirling motion can be removed through a radial main inlet 12, instead of a tangential one.

The valve main body 10 permits complete flushing out of the valve interior, in particular the swirl chamber 11 and the outlet 13 adjoining the latter in the filling direction, with a minimum quantity of flushing fluid, owing to the high turbulence that can be achieved in the swirl chamber 11, and a comparatively small surface area. For this reason, the valve main body 10 is particularly suitable for a frequent change of filling product, for example including the container, in particular of components to be metered in. Owing to the particularly effective capacity for flushing out, the valve main body 10 can also be used in aseptic filling machines.

The integration of control and shut-off function in the valve main body 10 permits a reduction in the number of components and a simplification of the product path. This leads to lower pressure losses and contributes to a more careful handling of the product and to reduced frothing during the filling operation.

The compact design of the valve main body 10 additionally permits a hygienic integration of the valve cone drive and optionally of further control functions in the valve head, i.e. above the swirl chamber 11, for example an integration of gas valves for pressurising the containers 100, return gas lines, depressurising lines, solenoid valves for further separate control functions in the region of the filling member 1, such as lifting and lowering a valve, metering in components, and the like. Similarly, for example, a control circuit board for realising non-central control architectures can be installed in the valve head.

Since the filling member 1 with the valve main body 10 can be extended modularly and, in addition, can be used for wall bottling and for free-jet filling or for products to be bottled at atmospheric pressure, the multiplicity of variants of filling members for different applications is reduced. Therefore, the effort in terms of care and maintenance and the number of machine variants are reduced. Bottling plants which are equipped with filling members 1 of the type described herein are universally useable. A great diversity of different beverages, container formats and container materials (PET, glass, can, still, carbonated, etc.) can be bottled with them.

Figure 4:
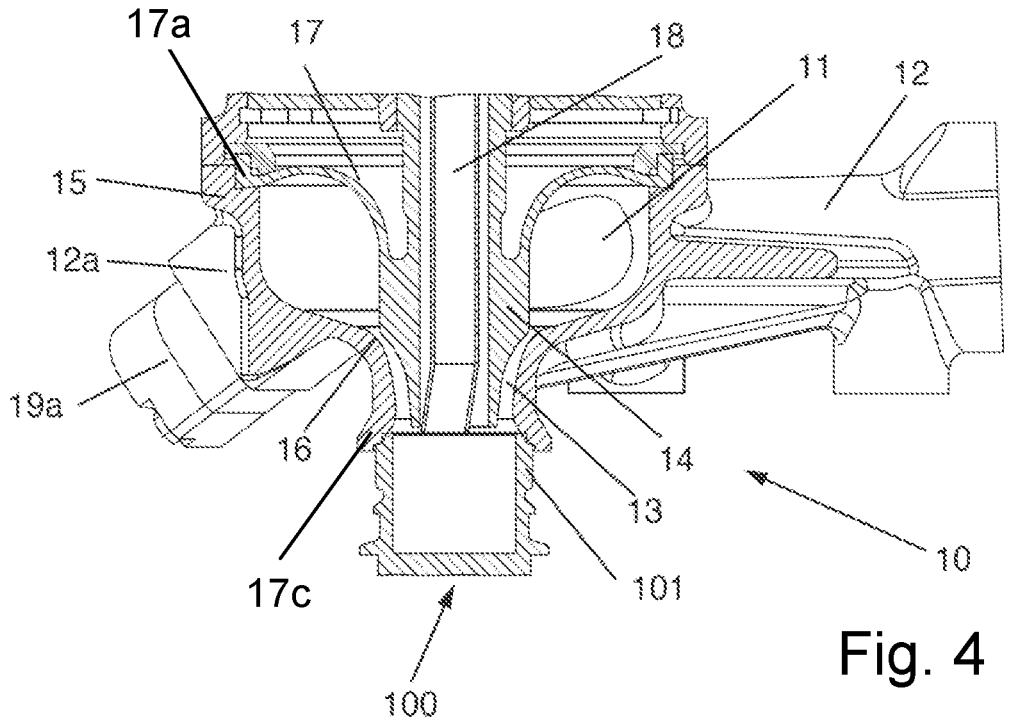
FIG. 4 shows a cross-sectional view of a valve main body with swirl chamber, valve cone and membrane according to a further exemplary embodiment.
Figure 5:
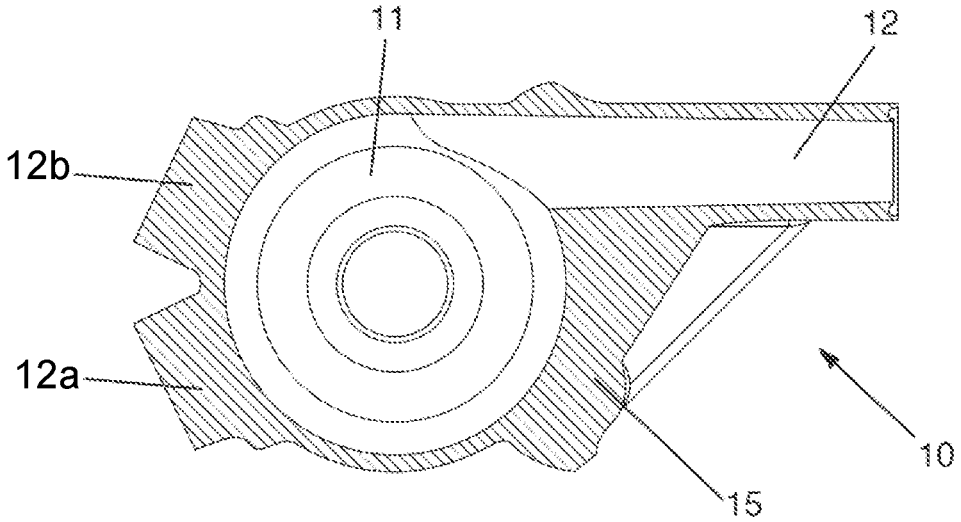
FIG. 5 shows the valve main body from FIG. 4 in a top view.

FIG. 4 is a cross-sectional view of a valve main body 10 with swirl generation according to a further exemplary embodiment. A plan view of the valve main body 10 is shown in FIG. 5. The basic construction and the technical functions associated therewith are similar to the exemplary embodiment of FIGS. 1, 2 and 3. However, the valve main body 10 according to FIGS. 4 and 5 has a functional scope which is extended in relation to the above-described embodiment variants.

The valve main body 10 thus has two further inlets which are denoted herein as first and second secondary inlets 12*a*, 12*b*. The number of two secondary inlets 12*a*, 12*b* is only by way of example and can vary depending on the intended use.

The secondary inlets 12*a*, 12*b* permit the supply of further components, which are also referred to herein as additional component(s), directly into the swirl chamber 11. In order to be able to meter the quantities of additional components, the secondary inlets 12*a*, 12*b* can be provided in each case with a metering valve 19*a*. The metering valve associated with the secondary inlet 12*b* cannot be seen in the perspective view of FIG. 4 but can be designed in the same way as the metering valve 19*a*.

By means of the secondary inlets 12*a*, 12*b*, additional components are admixed directly in the swirl chamber 11, thus ensuring an effective capacity for flushing out the valve main body 10 and minimising any potential migration of flavourings. Owing to the integration of the supply of metered components into the valve housing 15, no hoses or additional lines are required. The valve main body 10 is thereby particularly suitable for an instant change of product.

The valve main body 10 is in many respects of modular construction and can thus be functionally extended and adapted in a simple manner. The membrane 17 has a clamping portion 17*a* which is configured for fastening in the valve housing 15. The clamping portion 17*a* is an annular structure which can be fastened to the membrane 17 as an integral part thereof or as a separate element. In the radially inner region, the membrane 17 is fastened to the valve cone 14.

A material pairing of Teflon for the valve cone 14 and for the membrane 17 is suitable in one or more embodiments. The flexibility of the membrane and the composition of the material assist in bottling the filling product with a swirling motion, even in the event of very small filling streams. In addition, any unintended local maximum flow at the start of a bottling operation, before a uniform flow is set with a swirling motion, is counteracted. In combination with a valve cone 14 made of Teflon which optimises the outflow behaviour owing to low surface energy, a uniform, steady and uninterrupted bottling can thus be realised with short filling times.

The modular construction enables different membranes 17 and/or valve cones 14 with different flow and bottling properties to be used and combined without the entire valve main body 10 having to be redesigned. The remaining valve main body 10, in particular the valve housing 15, can be an invariable, standardised component, while the valve properties can easily be varied by the structural unit consisting of valve cone 14 and membrane 17. In this way, for example, the size of the swirl chamber 11, the shape of the valve cone 14, in particular the outlet contour thereof, the pressurising position and the pressurising force of the valve cone 14 can be modified by the membrane 17 and the like in a simple manner and adapted to the desired application environment.

Returning to FIGS. 1 and 4, a possible attachment of a bottle-shaped container 100 to a mouth section 15*c* of the valve housing 15 is shown therein. The container 100 has a container mouth 101 which is in contact with the mouth section 15*c* in the wall bottling mode, as a result of which the filling product, in which a swirling motion is induced by the swirl chamber 11 during the bottling operation, flows downwards under the action of the centrifugal force in a spiral movement on the container wall.

The tangential main inlet 12 set forth above leaves the upper side of the valve main body 10 unobstructed in such a way that one or more modular valve components can be attached. In addition, the wall bottling of the filling product means that the space on the axis of the container 100 is filled only with gas, and therefore said central sections of the filling member 1 can be used for a sensor device 20, the construction and function of which are set forth below with respect to FIG. 1.

The sensor device 20 has a sensor housing 21 which extends upwards in one embodiment centrally as an extension of the valve cone 14 or of the gas duct 18. The sensor device 20 furthermore has a sensor head 22 with a transmit/receive surface 22*a*.

The sensor device 20 is in one embodiment designed as an ultrasonic reflex scanner or ultrasonic sensor. In this case, the gas duct 18 and the container wall form a resonance space for the ultrasonic signal. The container base or the liquid surface act as reflection surfaces. However, the sensor device 20 can also implement a different measuring principle or measuring method, such as, for example, an optical measurement or a measuring method based on radar waves or microwaves.

By means of the compact construction of the filling member 1, the sensor head 21 can be positioned at a very short distance from the container mouth 101, as a result of which a large sensor field of view S can be achieved. This is furthermore assisted by the swirling motion of the filling product, as a result of which a stable "eye" is formed during the bottling operation, through which the sensor head 21 can "look" without disturbance. As a result, there are two possibilities, of either using the sensor device 20 directly as a filling level sensor which detects the removal of the liquid surface of the filling product in the container 100 by the sensor head 22, or of additionally installing a filling level sensor (not shown in the figures).

One, a plurality of or all of the gas paths 18*a*, 18*b* open in various embodiments essentially directly below the sensor head 22 into the gas duct 18. Soiling of the transmit/receive surface 22*a* can thereby be suppressed or at least reduced by the synergetic effect of the gas flows in the gas duct 18.

One, a plurality or all of the gas paths 18*a*, 18*b* can be guided tangentially into the central gas duct 18. Such a tangential arrangement of the gas paths 18*a*, 18*b* upstream of the transmit/receive surface 22*a* leads, in a cleaning mode, for example with water, to effective cleaning of the transmit/receive surface 22*a*. In addition, during normal operation without excessive frothing during the bottling operation, the sensor head 22 comes into contact only with gaseous media, but not with liquids. In the event of a possible bursting of the container 100, the sensor head 22 by its position in the gas duct 18 is readily protected from fragments flying around, for example glass shards.

The sensor device 20 permits monitoring of a plurality of or even all of the steps of the bottling operation. For this purpose, an evaluation device 30 is provided which communicates with the sensor device 20 and is configured to evaluate the analogue or digital detection signals of the sensor device 20. The detection signals of the sensor device 20 can thus be used by the evaluation device 30, for example, in order to infer one or more of the following measured variables: filling height of the filling product in the container 100; gas pressure in the gas duct 18 or container 100; froth quantity/height or froth composition in the container 100; container position relative to the mouth section 15*c*; structural state of the container 100, i.e. whether the container 100 is intact or damaged.

The evaluation device 30 can be part of a filling member controller 40 or can be in communication with such in order to control and/or to regulate the bottling operation. The communication can take place in analogue or digital form, and in wired or wireless form. The evaluation device 30 and filling member controller 40 can be realised centrally or decentrally, as part of Internet-based and/or cloud-based applications or in some other way, and recourse can optionally be made to databases. The sensor device 20, evaluation device 30 and filling member controller 40 can be realised integrally or by separate electronic components. By contrast to the illustration in FIG. 1, the evaluation device 30 can be installed, for example, in the sensor housing 21, and the evaluation device 30 and filling member controller 40 can be implemented by a computer unit, for example assisted by software.

If the position of the container 100 relative to the filling member 1 is changed, for example during the introduction, pressing on and removal of the container 100, the signal received by the sensor device 20 also changes, as a result of which steps which are associated with a position change of the container 100 can be monitored and correspondingly controlled. In this way, for example, the filling operation can be automatically started as soon as a container 100 is present and is located at the correct position.

Owing to the dependency of the sound speed on gas properties, such as, for example, composition, pressure, temperature, etc., furthermore steps of gas exchange, pressure increase or reduction/evacuation can be monitored and correspondingly controlled by the sensor device 20.

Similarly, possible frothing during the filling and/or relieving of load of the container 100 can be monitored by the sensor device 20.

The monitoring and control of the metering of the filling product is possible in all the containers 100. The increase in the filling speed can be used as a control variable.

Container defects, for example bursting of bottles, can likewise be identified by the sensor device 20.

The above-described scope of use of the sensor device 20 is provided in the event of a measuring principle which is based on the transmitting and detecting of ultrasonic waves. However, the scope of use can be completely or at least partially also obtained by other measuring methods, for example optical measurements.

The use of such a sensor device 20 placed in the gas duct 18 of the filling member 1 with swirl chamber 11 permits a simplification in terms of mechanical engineering since previously used sensors, for example for flow, filling level, container detection (Flada) and pressure, can be replaced and at the same time a plurality of or even all of the steps in the filling operation can be monitored continuously with a single sensor.

Furthermore, steps or sequences during the filling operation that hitherto could only be inadequately monitored, if at all, relating, for example, to the operation of positioning and/or pressing the container 100 against the mouth section 15*c* of the filling member 1, can be monitored by the sensor device 20.

The use of a single sensor device 20 in the filling member 1 leads to a lower maintenance effort and a cost saving because of there being fewer sensors and fewer variants.

It is possible to use the sensor device 20 for PET bottles and for glass bottles, cans or other types of container, as a result of which sensor variants are reduced.

Even filling products with low conductivities can be easily measured, in contrast to using electric rod probes.

The use of flow meters, for example costly Coriolis mass flow meters, is unnecessary.

The necessary communication between the evaluation device 30, the filling member controller 40 and/or a master plant controller can be substantially reduced with decentral controller concepts. The requirement for the permitted transmission delay is also reduced since, for example, the starting signal for the bottling operation no longer has to be transmitted.

If applicable, all of the individual features which are illustrated in the exemplary embodiments can be combined with one another and/or replaced without departing from the scope of the invention.

What is claimed is:

1. An apparatus for filling a container with a filling product, comprising:

a valve main body comprising:

an outlet configured to introduce the filling product into the container, and a swirl chamber fluidically connected to an outlet and configured to induce a swirling motion in the filling product as the filling product is introduced into the container;

a valve cone that is at least partially arranged in the valve main body, defines an axial direction, and through which a gas duct penetrates in the axial direction;

a sensor device comprising a sensor head that is configured to detect at least one signal and is arranged in the gas duct; and at least one gas path that opens laterally into the gas duct, wherein the at least one gas path opens into the gas duct directly below the sensor head.

2. The apparatus of claim 1, wherein the valve cone is configured to be displaceable in the axial direction to enable flow control of the filling product through the outlet.

3. The apparatus of claim 1, wherein the outlet is annular, and the swirl chamber tapers towards the outlet, resulting in the filling product, after exiting from the outlet, flowing downward in a spiral movement in the container.

4. The apparatus of claim 1, wherein:

the valve main body further comprises a valve seat, and the valve cone and the valve seat are configured such that, in a shut-off position, the valve cone is sealingly in contact with the valve seat for sealing the outlet.

5. The apparatus of claim 1, wherein the valve main body further comprises one or more secondary inlets that open into the swirl chamber and are configured to correspondingly introduce one or more additional components of the filling product into the swirl chamber in such a manner that the additional components are mixed therein with a main component of the filling product.

6. The apparatus of claim 1, wherein the valve main body further comprises:

a valve housing that forms at least part of a wall bounding the swirl chamber and the outlet, and a membrane made of a deformable material, the membrane forming a further part of the wall bounding the swirl chamber and the outlet, and being attached at an outer contour to the valve housing.

7. The apparatus of claim 1, wherein the at least one gas path is in a form of a flexible hose, and the at least one gas path opens tangentially into the gas duct.

8. The apparatus of claim 1, wherein the sensor head comprises a transmit/receive surface that is configured to emit a transmit signal in a direction of the container and to receive a receive signal initiated by the transmit signal.

9. The apparatus of claim 8, wherein the transmit signal comprises an ultrasonic signal, an optical signal, a radar wave, or a microwave.

10. The apparatus of claim 1, further comprising an evaluation device that communicates with the sensor device and is configured to infer one or more measured variables from the at least one signal detected by the sensor device, wherein the one or more measured variables comprises a filling height of the filling product in the container, a gas pressure, a gas composition or a gas concentration in the gas duct and container, a froth quantity/height and/or froth composition in the container, a container position, and/or a structural state of the container.

11. The apparatus of claim 10, further comprising a filling member controller that communicates with the evaluation device and is configured to control and/or to regulate handling of the container, wherein the handling comprises one or more of: positioning the container, pressing the container against a mouth section of the valve main body, introducing a gas through the gas duct into the container, drawing off a gas out of the container through the gas duct, generating a positive pressure in the container, generating a negative pressure in the container, introducing the filling product into the container, relieving the container of load, or removing the container from the mouth section of the valve main body.

12. The apparatus of claim 1, wherein the swirl chamber comprises an annular shape, a cross-sectional contour of which has a round shape in a direction of extent and perpendicularly to the direction of extent.

13. The apparatus of claim 12, wherein the swirl chamber extends substantially axially symmetrically about the valve cone.

14. The apparatus of claim 1, wherein the valve main body further comprises a main inlet that opens tangentially into the swirl chamber and is configured to introduce the filling product or a main component of the filling product into the swirl chamber in such a manner that a swirling motion is induced in the filling product in the swirl chamber.

15. The apparatus of claim 14, wherein at least an axial outer wall of the swirl chamber merges continuously and differentiably into the main inlet, and/or the main inlet in a region of a mouth leading into the swirl chamber has substantially the same cross-sectional contour perpendicularly to a direction of extent as the swirl chamber.

16. A method for filling a container, comprising:

providing an apparatus comprising:

a valve main body comprising:

an outlet configured to introduce a filling product into the container, and a swirl chamber fluidically connected to an outlet and configured to induce a swirling motion in the filling product as the filling product is introduced into the container, a valve cone that is at least partially arranged in the valve main body, and defines an axial direction and through which a gas duct penetrates in the axial direction, a sensor device comprising a sensor head that is configured to detect at least one signal and is arranged in the gas duct, and at least one gas path that opens laterally into the gas duct, wherein the at least one gas path opens into the gas duct directly below the sensor head;

introducing the filling product into the swirl chamber of the valve main body;

inducing a swirling motion in the filling product in the swirl chamber;

discharging the swirling filling product from the swirl chamber via the outlet of the valve main body into the container, resulting in the filling product flowing along a container inner wall into the container; and detecting at least one signal that propagates from the container through the gas duct by the sensor head of the sensor device.

17. The method of claim 16, further comprising inferring one or more measured variables from the at least one signal detected by the sensor device.

18. The method of claim 17, wherein the one or more measured variables comprise a filling height of the filling product in the container, a gas pressure, a gas composition or a gas concentration in the gas duct and the container, a froth quantity/height and/or a froth composition in the container, a container position, and/or a structural state of the container.

19. The method of claim 16, further comprising one or more of the following:

positioning the container;

pressing the container against a mouth section of the valve main body;

introducing a gas through the gas duct into the container;

drawing off a gas out of the container through the gas duct;

generating a positive pressure in the container;

generating a negative pressure in the container;

introducing the filling product into the container;

relieving the container of load; or removing the container from the mouth section of the valve main body.

* * * * *